US007165678B2

(12) United States Patent
Proto Parisi

(10) Patent No.: US 7,165,678 B2
(45) Date of Patent: Jan. 23, 2007

(54) GIFT PACKAGING

(75) Inventor: Fernando Proto Parisi, Santiago (CL)

(73) Assignee: SERPLAS - Industria di Plastico Serplas S.A., Santiago (CL)

( * ) Notice: Subject to any disclaimer, the term of this patent is extended or adjusted under 35 U.S.C. 154(b) by 87 days.

(21) Appl. No.: 10/516,976

(22) PCT Filed: Jun. 11, 2003

(86) PCT No.: PCT/IT03/00364

§ 371 (c)(1),
(2), (4) Date: Dec. 6, 2004

(87) PCT Pub. No.: WO2004/014749
PCT Pub. Date: Feb. 19, 2004

(65) Prior Publication Data

US 2005/0205461 A1 Sep. 22, 2005

(30) Foreign Application Priority Data

Aug. 9, 2002 (CL) ..... 1807-2002
May 29, 2003 (IT) ..... MI2003A1076

(51) Int. Cl.
*B65D 69/00* (2006.01)

(52) U.S. Cl. ..... 206/575; 229/87.19

(58) Field of Classification Search ..... 206/216, 206/575, 459.5, 813, 457; 229/80, 87, 87.1, 229/87.19, 300, 301; 40/312; 428/4, 5
See application file for complete search history.

(56) References Cited

U.S. PATENT DOCUMENTS

| | | | | |
|---|---|---|---|---|
| 2,826,225 | A * | 3/1958 | Hagenbuch | 139/383 R |
| 3,310,225 | A * | 3/1967 | Hoblit et al. | 383/86 |
| 4,329,382 | A * | 5/1982 | Truskolaski et al. | 428/4 |
| 4,777,066 | A * | 10/1988 | White et al. | 428/4 |
| 5,392,983 | A | 2/1995 | Clarke-Bolling et al. | |
| 5,490,597 | A * | 2/1996 | Schluger | 206/575 |
| 5,497,876 | A | 3/1996 | Fleming | |
| 5,776,571 | A * | 7/1998 | Michlin et al. | 428/40.1 |
| 5,850,963 | A * | 12/1998 | Chang | 229/116.5 |
| 6,155,481 | A * | 12/2000 | Rawlings | 229/300 |
| 2001/0035453 | A1 * | 11/2001 | Felton | 229/80 |

FOREIGN PATENT DOCUMENTS

| | | |
|---|---|---|
| DE | 35 46 094 A1 | 10/1986 |
| WO | 95/03229 | 2/1995 |

* cited by examiner

*Primary Examiner*—Mickey Yu
*Assistant Examiner*—Steven Pollicoff
(74) *Attorney, Agent, or Firm*—Michael J. Striker

(57) ABSTRACT

Set of materials for packaging presents and the like comprising means for containing the presents, for closing the containing means, for creating a decorative "bow", for writing a message of greetings and for indicating the names of sender and recipient.

9 Claims, 3 Drawing Sheets

GIFT PACKAGING

CROSS-REFERENCE

The invention described and claimed hereinbelow is also described in PCT/IT 03/00364, filed Jun. 11, 2003, based on 1807-2002, filed Aug. 9, 2003 in Chile, and MI2003A001076, filed May 29, 2003, in Italy. This Italian Patent Application, whose subject matter is incorporated here by reference, provides the basis for a claim of priority of invention under 35 U.S.C. 119 (a)–(d).

BACKGROUND OF THE INVENTION

The invention concerns packaging for presents and the like.

A present is usually delivered to the recipient in an attractive package adorned with a "bow" of ribbon, completed with a written message and with indication of the sender and the consignee.

To make up the package involves separate purchases of the materials such as sheets of patterned paper or ready-made bags, ribbons for decoration, or ready-made "bows", cards on which to write a message for the recipient, materials for closing the package, generally consisting of a roll of transparent adhesive tape.

This is a troublesome process especially if many presents have to be packed, as happens at Christmas or at other events when many of such packages must be despatched.

If only one package has to be made up, it is a nuisance having to carry the materials home from a shop, especially as they are so easily creased.

In the case of a number of packages, the risk of spoiling packing materials is even greater because of the quantities of different components while, on arriving home, much space is needed for placing them, cutting up the packing paper and making up the packages.

Even when a supplier of such materials provides everything needed, the materials themselves occupy as much space as a shopping bag.

SUMMARY OF THE INVENTION

The invention here to be described avoids these drawbacks in addition to offering other considerable advantages as well.

Subject of the invention is a set of materials for packaging presents and the like comprising means for containing the present, for closing the container, for creating a decorative "bow", for writing a message of greetings and for indicating the names of sender and recipient.

In one advantageous execution, the means for containing the present is an envelope.

The means of closure comprise a flap covering the full width of the front face of the envelope and a self-adhesive strip of substantially the same width as that of the flap, covering the entire width of the border of the rear face of the envelope.

The means for creating the decorative "bow" consist of a flat extended length of the material used comprising a pair of superimposed ribbons between which is a pair of flat tie-strips, these also superimposed.

The ribbons are held together by transversal pairs of joining points on either side of the pair of tie-strips but separated by a space so that said strips can slide freely in relation to the ribbons.

The pairs of ribbons and tie-strips are joined together at one end.

By sliding the free ends of the ribbons along the tie-strips as far as their joined ends, the ribbons will form a series of loops that spread out side by side from said joined ends so forming a "bow"-type decoration.

The means for writing a message consists of an area on the rear face of the envelope comprising sides prepared for partial o total detachment and at least one non-tear-off side.

The inside of that face at the position of said area presents a "patch" applied by adhesive or other means, for ensuring continuity of said face even, if the part to be used for the message is detached or folded back on its non-tear-off side.

The means for indicating the names of the sender and recipient consists of a label applied to an adhesive area on the rear face of the envelope, to which area the bow can be applied when left free after transferring the label to the front face of the envelope.

The outer faces of the containing means preferably present some decorative design.

In one advantageous execution the envelope is made of paper.

The pair of ribbons and the pair of tie-strips can also consist of a single ribbon and a single tie-strip folded in the middle.

In one type of execution the distances between the transversal pairs of joining points between the two ribbons, differ reciprocally.

In one type of execution said distances between the transversal pairs of joining points of the two ribbons decrease starting from the end where they are joined together.

The area for writing a message presents, on the internal face, a layer of adhesive enabling it to be removed and affixed to any other position on the envelope.

The invention offers evident avantages.

The set of materials, that can be purchased and carried to its point of use lying flat as initially disposed or rolled up, facilitates the operation of packaging presents in general, lessening the risk of spoiling the components if purchased separately.

The package is given a "professional" look which enhances the whole decorative effect, even if achieved with great simplicity.

BRIEF DESCRIPTION OF THE DRAWINGS

Characteristics and purposes of the invention will be made still clearer by the following examples of its execution illustrated by diagrammatically drawn figures.

DETAILED DESCRIPTION OF THE PREFERRED EMBODIMENTS

Figure 1:
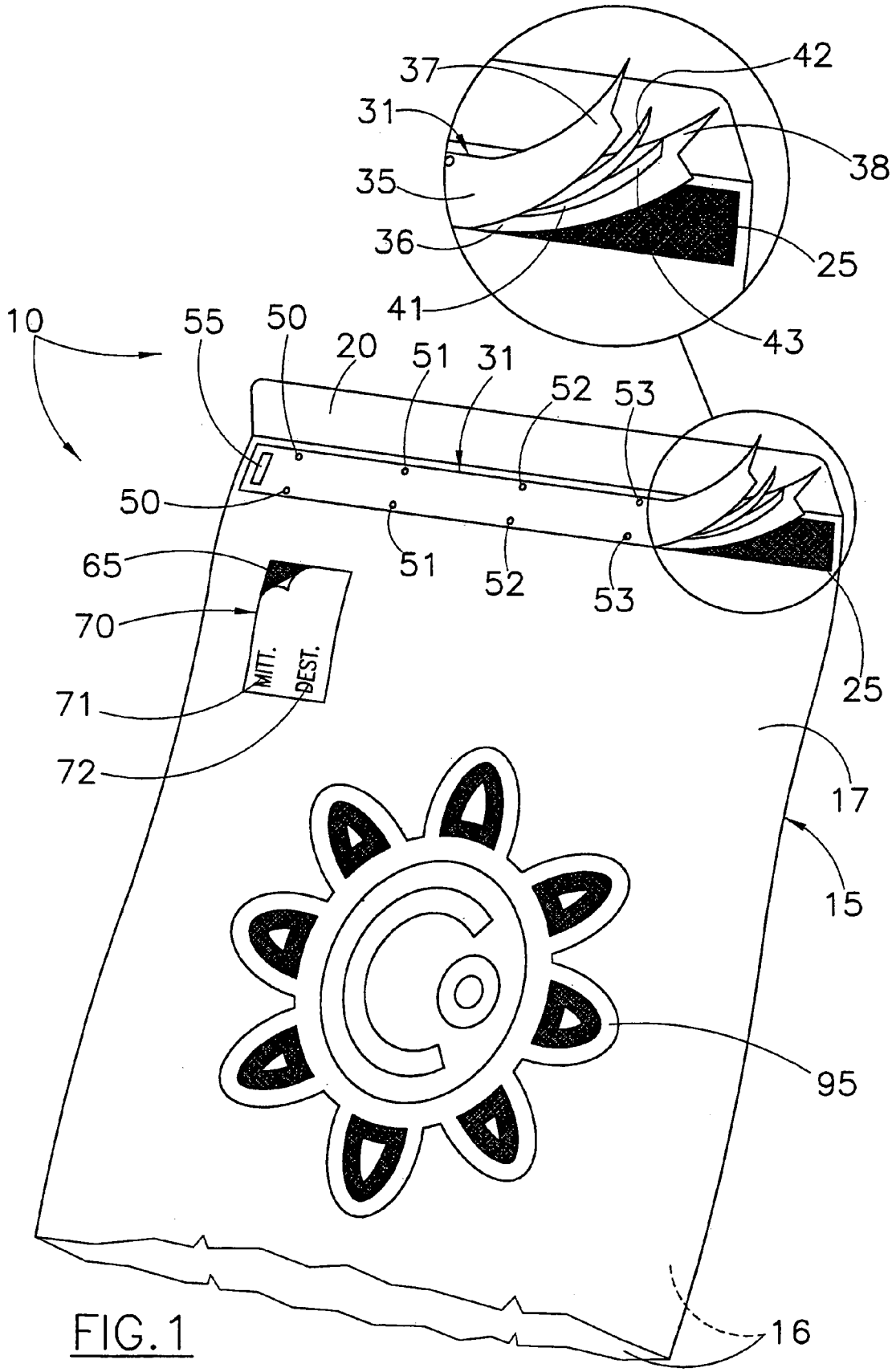
FIG. 1 A set of materials for packaging presents and the like, rear perspective.

The set 10 comprises a container in the form of an envelope 15 with a front face 16 and a rear face 17.

The sealing flap 20 is joined to the edge of the front face 16.

Figure 4:
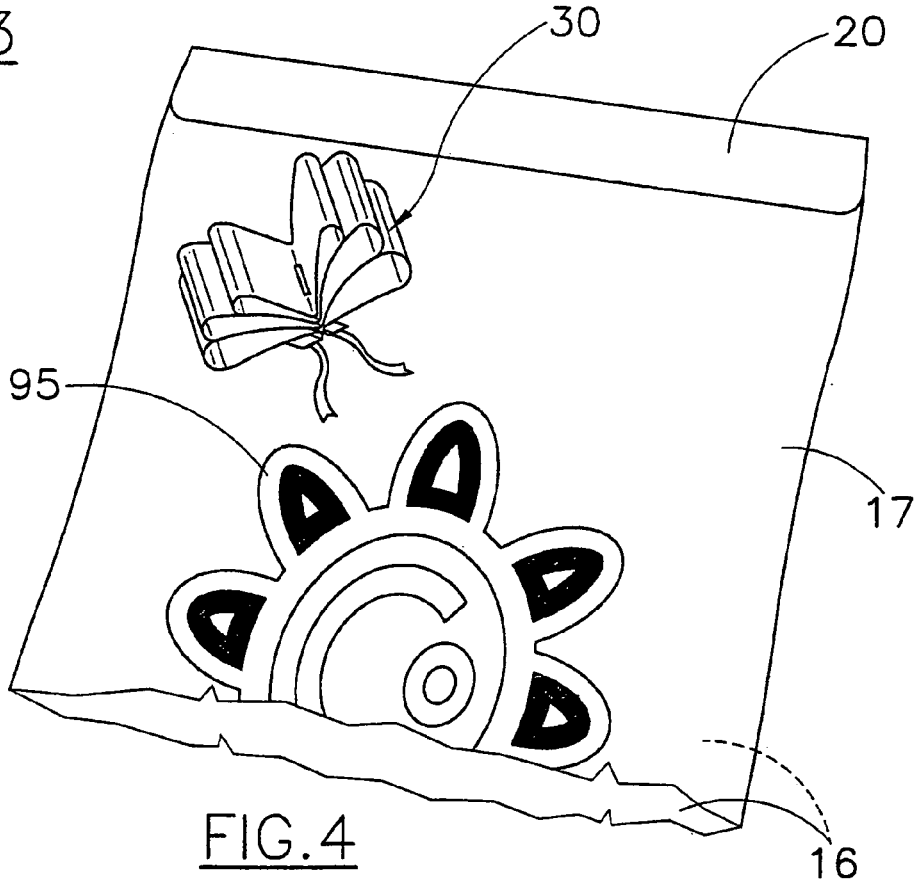
FIG. 4 The package, rear perspective.

Close to the edge on the rear face 17 is a self-adhesive strip 25 that will lie under the flap 20 when it is folded down onto the rear face 17 (FIG. 4).

The "bow" 30 is laid flat 31 full length on said self-adhesive strip 25. Thus laid 31, shows (FIGS. 1–3) that it consists of a pair of ribbons 35, 36 with their respective ends 37, 38 and in between them a pair of flat tie-strips 40, 41 with their respective ends 42, 43.

The length of the ribbons 35, 36 and of the tie-strips 40, 41 corresponds substantially to the width of the envelope 15, the width of said ribbons corresponding to the width of the self-adhesive strip 25 so that, when laid at full length 31, the "bow" 30 practically covers said self-adhesive strip 25.

The two ribbons 35, 36 are joined (FIG. 2) by a series of transversal pairs of joining points, such as 50—50, 51—51, 52—52, 53—53 on either side of the pair of tie-strips so that these latter can freely slide between the ribbons.

The ends 37, 38 of the ribbons 35, 36 are given a swallow-tail cut.

At one end the pair of ribbons and the pair of tie-strips are joined 55 together.

A label 70, to be used for the name of the sender 71 and of the recipient 72, is attached by adhesive near the upper edge of the rear face 17 of the envelope.

The package is very simple to make up.

The ribbon laid flat 31 is detached from the self-adhesive strip 25.

Figure 2:
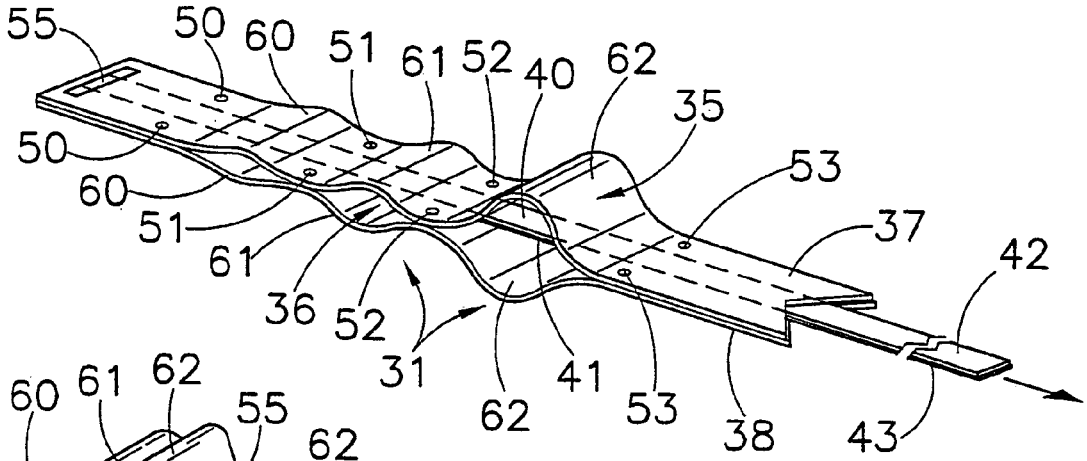
FIG. 2 The decorative "bow" laid out flat, perspective.
Figure 3:
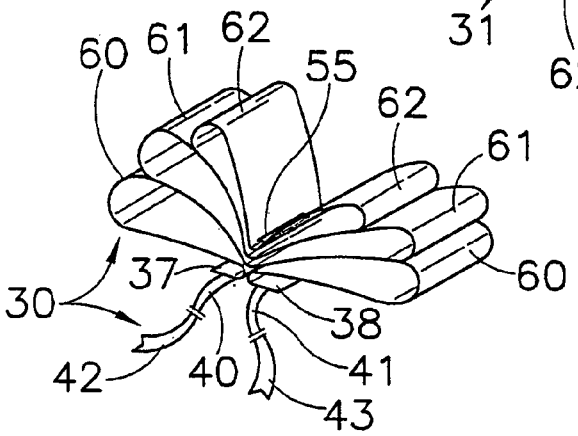
FIG. 3 The "bow", perspective.

On pulling the tie-strips 40, 41 through the two ribbons 35, 36 as shown in FIG. 2, the areas between the joining points 50-53 fold up forming pairs of wave-like folds, 60-62, finally creating the "bow" 30 (FIG. 3).

In FIG. 3, the connecting point 55 between ribbons and tie-strips lies in the centre of the bow.

On detaching the flat ribbon 31, the self-adhesive strip 25 is laid bare and can be used, when the present has been put inside, to close the envelope by folding the flap 20 over the edge of the front face 16 onto said self-adhesive strip.

The label 70 on the rear face 17 of the envelope is then detached and can be placed, for example, on the front face 16 (FIG. 5), leaving free an adhesive area 65 on which the "bow", when ready, can be placed, as shown in FIG. 4.

Figure 5:
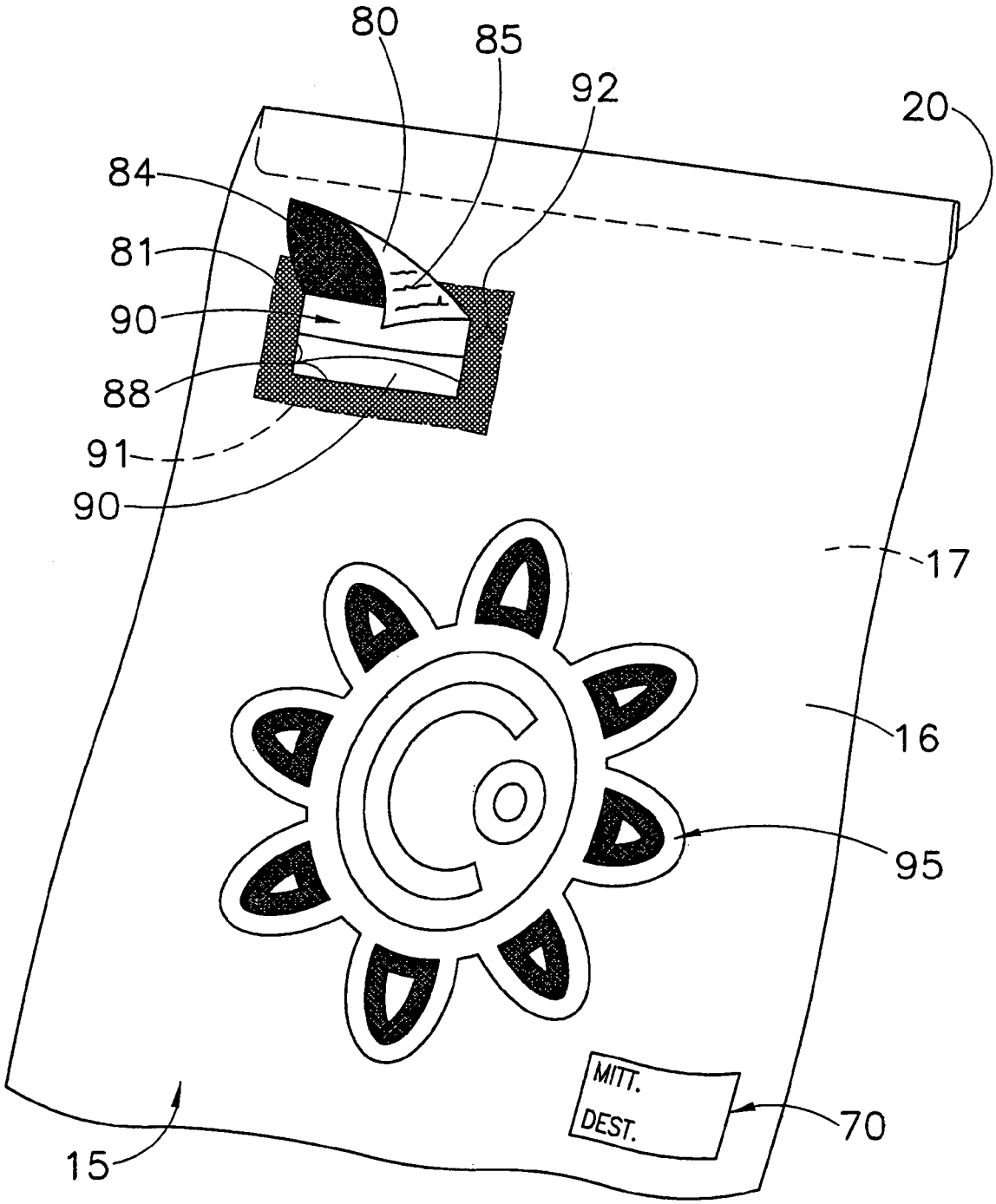
FIG. 5 The package, front perspective.

An area 80 is prepared, on said front face 16, for printed or written greetings 85, said area having sides prepared for detachment and at least one non-tear-off side 81, allowing it to be removed or folded back as seen in FIG. 5.

The internal surface of said area 80 is adhesive 84 and can be affixed to any part of the envelope.

The window 88 opened by removal of the label, is then closed by a "patch" 90 joined to the internal surface 92 of the envelope by an adhesive 91 or other means prepared around said window 88. The external surfaces of the envelope present decorations 95.

The invention claimed is:

1. Set of materials for packaging an item, comprising:

means for containing the item, for closing the containing means, for creating a decorative bow, for writing greetings and for indicating the names of the sender and recipient, wherein the closing means comprise a flap covering the full width of a front face of the containing means and a self-adhesive strip having a width that is substantially the same as a width of the flap and covering an entire width of a border of a rear face of the closing means, wherein the means for creating the decorative bow is disposed in a flat, laid-out position along the full length of the self-adhesive strip of the closing means and comprises a pair of superimposed ribbons, wherein a pair of superimposed, flat tie-strips is positioned between the pair of superimposed ribbons, wherein the ribbons are joined together by transversally placed pairs of joining points on each side of the pair of tie-strips at a distance from said tie-strips so as to allow the tie-strips to slide freely between the ribbons, said pairs of ribbons and tie-strips being joined together at one end, such that by causing free ends of the ribbons to slide in relation to the tie-strips as far as joined ends of the ribbons and tie-strips, a series of folds that spread out side by side from the joined ends are formed, thereby creating a bow.

2. Set of materials for packaging an item as defined in claim 1, wherein the containing means substantially consists of an envelope.

3. Set of materials for packaging an item as defined in claim 2, wherein the means for indicating the names of sender and recipient is a label applied to an adhesive area on the rear face of the envelope, permitting application of the bow on said adhesive area when left free after the label has been transferred to the front face of the envelope.

4. Set of materials for packaging an item as defined in claim 2, wherein the envelope is made of paper.

5. Set of materials for packaging an item as defined in claim 2, wherein the means for writing greetings consists of an area on the rear face of the envelope comprising sides prepared for detachment that permit partial or total removal, and at least one non tear-off side, there being fixed, by adhesive or other means, to an internal rear face at the position of said area, a patch to ensure continuity of said face even if the area for writing greetings is detached or folded back onto one non-tear-off side.

6. Set of materials for packaging an item as defined in claim 5, wherein the internal face of the area for writing greetings presents a self-adhesive layer allowing it to be removed and applied to any other part of the envelope.

7. Set of materials for packaging an item as defined in claim 1, wherein an external face of the containing means presents decorative designs.

8. Set of materials for packaging an item as defined in claim 1, wherein distances between the transversally placed pairs of joining points of the two ribbons differ reciprocally.

9. Set of materials for packaging an item as defined in claim 1, wherein the distances between the transversally placed pairs of joining points of the two ribbons decrease starting from the area where their ends are joined as the bow is created.

* * * * *